US011578926B2

(12) United States Patent
Shimon

(10) Patent No.: US 11,578,926 B2
(45) Date of Patent: Feb. 14, 2023

(54) CORROSION RESISTANT HEAT EXCHANGER AND TUBE SHEET L'HEREFOR

(71) Applicant: CG THERMAL, LLC, Twinsburg, OH (US)

(72) Inventor: Ido Shimon, Pardes Hana (IL)

(73) Assignee: CG THERMAL, LLC, Twinsburg, OH (US)

( * ) Notice: Subject to any disclaimer, the term of this patent is extended or adjusted under 35 U.S.C. 154(b) by 0 days.

(21) Appl. No.: 17/372,427

(22) Filed: Jul. 10, 2021

(65) Prior Publication Data

US 2022/0026156 A1 Jan. 27, 2022

Related U.S. Application Data

(60) Provisional application No. 63/054,405, filed on Jul. 21, 2020.

(51) Int. Cl.

| | |
|---|---|
| ***F28D 7/10*** | (2006.01) |
| ***F28F 9/16*** | (2006.01) |
| ***F28F 21/00*** | (2006.01) |
| ***F28F 19/04*** | (2006.01) |
| ***F28F 21/02*** | (2006.01) |

(52) U.S. Cl.

CPC ..... *F28D 7/10* (2013.01); *F28F 9/162* (2013.01); *F28F 19/04* (2013.01); *F28F 21/006* (2013.01); *F28F 21/02* (2013.01); *F28F 2230/00* (2013.01); *F28F 2275/02* (2013.01); *F28F 2275/08* (2013.01)

(58) Field of Classification Search

CPC ... F28D 7/10; F28F 9/162; F28F 19/04; F28F 21/006; F28F 21/02; F28F 2275/08

See application file for complete search history.

(56) References Cited

U.S. PATENT DOCUMENTS 3,923,314 A * 12/1975 Lawler ..... F28F 21/04 277/606
4,244,423 A * 1/1981 Thut ..... F28F 9/0219 165/DIG. 56
4,474,233 A * 10/1984 Swozil ..... C04B 35/52 165/184

(Continued)

FOREIGN PATENT DOCUMENTS

CA 2878976 A1 * 1/2014 ..... B05D 1/06
CN 2454752 Y 10/2001

(Continued)

OTHER PUBLICATIONS

International Search Report and Written Opinion from corresponding International Application No. PCT/US2021/041196 dated Oct. 27, 2021.

*Primary Examiner* — Jon T. Schermerhorn, Jr.
(74) *Attorney, Agent, or Firm* — Tucker Ellis LLP

(57) ABSTRACT

A tube sheet for a shell and tube heat exchanger. The tube sheet includes a substrate having a plurality of through holes; a plug made of a plug material located in each through hole, each plug having a through passage shaped to receive an end of a corresponding tube from the heat exchanger; and a lining made of a lining material, the lining encapsulates the substrate and fills a gap between each plug and the substrate.

9 Claims, 2 Drawing Sheets

(56) References Cited

U.S. PATENT DOCUMENTS

| | | | | | |
|---|---|---|---|---|---|
| 5,036,903 | A * | 8/1991 | Shook | F28F 19/02 165/905 |
| 6,206,603 | B1 * | 3/2001 | Graham | F28F 21/04 285/261 |
| 2005/0035591 | A1 * | 2/2005 | Graham | F28F 9/06 285/123.2 |
| 2006/0096736 | A1 * | 5/2006 | Burkhalter | F28F 11/00 165/76 |
| 2015/0129181 | A1 | 5/2015 | John et al. | |

FOREIGN PATENT DOCUMENTS

| | | | | |
|---|---|---|---|---|
| CN | 205980874 U | * | 2/2017 | |
| CN | 107218828 A | * | 9/2017 | F28D 7/16 |
| CN | 207866089 U | * | 9/2018 | B32B 15/085 |
| CN | 208187207 U | * | 12/2018 | F28D 7/16 |
| CN | 212902825 U | * | 4/2021 | |
| JP | H11108587 A | * | 4/1999 | |

* cited by examiner

CORROSION RESISTANT HEAT EXCHANGER AND TUBE SHEET L'HEREFOR

RELATED APPLICATION DATA

This application claims the benefit of U.S. Provisional Patent Application No. 63/054,405, filed Jul. 21, 2020, the disclosure of which is incorporated herein by reference in its entirety.

TECHNICAL FIELD

The technology of the present disclosure relates generally to shell and tube heat exchangers, and more particularly, to shell and tube heat exchangers having corrosion-resistant internal components, such as corrosion-resistant tube sheets (also referred to as end plates). The construction of the tube sheets allows for heat exchanges of larger diameter than previously possible.

BACKGROUND

Conventional corrosion resistant shell and tube heat exchangers, such as those constructed with glass or ceramic tubes, typically have tube sheets made from fluoropolymer (e.g., polytetrafluoroethylene or PTFE). The tube sheets are either of monolithic construction or have a steel substrate encapsulated in the fluoropolymer. The monolithic construction has limited strength properties, which limits the heat exchanger diameter to about 14" (e.g., 360 mm). The steel encapsulated tube sheets are stronger, but are still limited to a diameter of about 20" (e.g., 508 mm). The length of the heat exchanger is also limited since corrosion resistant tubing tends to be available in limited lengths. Therefore, the limit to the tube sheet diameter also effectively limits the heat transfer area of the resulting heat exchanger.

Conventional tube sheets made from PTFE have excellent corrosion resistance and good strength for supporting loads, such as those exerted by threaded tube nuts that seal joints between the tubes of the heat exchanger and the tube sheet. But PTFE is generally not melt-processable and it is difficult to form around a supporting steel substrate. For instance, the manufacturing of a PTFE-encapsulated steel tube sheet requires high pressures and closely controlled temperature, along with a thick PTFE cross section to allow the material to flow around the steel substrate. These manufacturing challenges limit the design of the steel substrate such that the tube sheet cannot support the loads imposed on a heat exchanger having a diameter larger than mentioned above.

SUMMARY

To improve the heat transfer capacity of corrosion resistant shell and tube heat exchangers, there is a need to increase the diameter of the tube sheets so that a larger number of tubes may be supported. Disclosed are improved tube sheets for corrosion resistant shell and tube heat exchangers. In one embodiment, the tube sheets may be sized so that the heat exchangers may range in diameter from about 6 inches to about 96 inches.

The tube sheets are made from a strong substrate (e.g., a substrate made from steel or carbon steel) that is encapsulated with a melt-processable material, such as a melt-processable fluoropolymer (e.g., perfluoroalkoxy or PFA). It is easier to form melt-processable material (e.g., PFA) around the substrate than non-melt-processable materials, such as PTFE. This allows the PFA layer to be much thinner than if PTFE were used, while still providing satisfactory corrosion protection. Since the protective PFA layer is relatively thin, the steel substrate may be commensurately thicker and stronger. But PFA has a lower strength than PTFE that may not be adequate to support the loads imposed by sealing tube nuts. Therefore, plugs having a higher strength than the melt-processable material (e.g., plugs made from a fluoropolymer such as PTFE) may be disposed in the melt-processable material. The plugs may be secured (e.g., bonded) to the melt-processable fluoropolymer, such as by welding, adhesive, etc., and then the plugs may be machined and threaded to accept sealing tube nuts.

A tube sheet of this arrangement may be much more robust than conventional tube sheets. Therefore, corrosion resistant heat exchangers may be built to much larger diameters than previously known, allowing for more tubes and increased heat exchanging capacity of the heat exchanger.

DETAILED DESCRIPTION OF EMBODIMENTS

Figure 1:
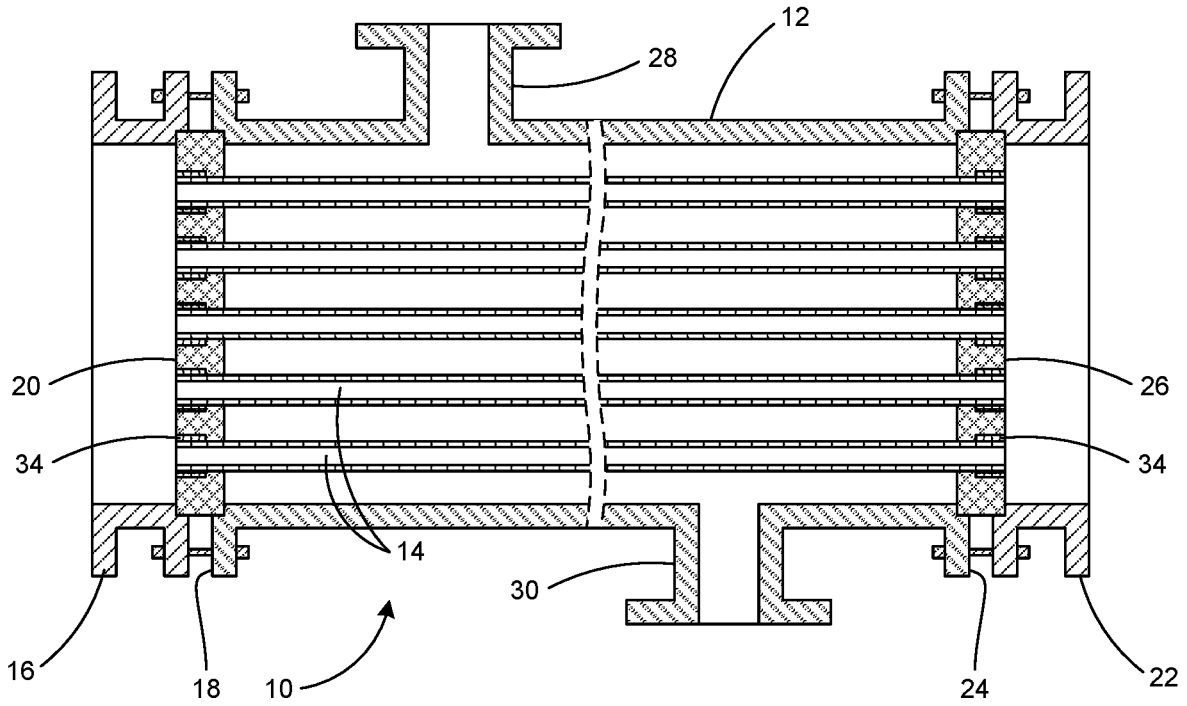
FIG. 1 is a cross-section of a heat exchanger having a tube sheet according to aspects of the disclosure.

Embodiments will now be described with reference to the drawings, wherein like reference numerals are used to refer to like elements throughout. It will be understood that the figures are not necessarily to scale. Features that are described and/or illustrated with respect to one embodiment may be used in the same way or in a similar way in one or more other embodiments and/or in combination with or instead of the features of the other embodiments.

With initial reference to FIG. 1, illustrated is a corrosion resistant shell and tube heat exchanger 10. Various internal components of the heat exchanger may be made from corrosion-resistant materials such as, but not limited to, fluoropolymers, ceramics, graphite, or reactive metals. FIG. 1 is relatively schematic in nature and, for simplicity of illustration, omits some components, such as bolts and other securing elements, seals, baffle cages, etc. Also, in FIG. 1, details of the tube sheets according to aspects of the disclosure are not illustrated. The tube sheets are illustrated in greater detail in FIGS. 2-4.

The heat exchanger 10 includes a shell assembly 12 that surrounds a plurality of heat transfer tubes 14. The tubes 14 may be made from, for example, glass or ceramic. Other material for the tubes 14 may be possible, such as graphite. An inlet clamp plate assembly 16 is secured to the shell assembly 12 at an inlet end 18 of the shell assembly 12. The inlet clamp plate assembly 16 holds an inlet tube sheet 20 against the inlet end 18 of the shell assembly 12 so that the tube sheet 20 covers an inlet opening in the shell assembly 12. Similarly, a discharge clamp plate assembly 22 is secured to the shell assembly 12 at a discharge end 24 of the shell assembly 12. The discharge clamp plate assembly 22 holds a discharge tube sheet 26 against the discharge end 24 of the shell assembly 12 so that the tube sheet 26 covers a discharge opening in the shell assembly 12. In one embodiment, the tube sheets 20 and 26 are of the same construction, but are connected to the shell assembly 12 in mirror image fashion. Therefore, in the explanation of the tube sheets that follows, reference is made to one of the tube sheets 20, 26 but applies equally to both tube sheets 20, 26. The clamp plate assemblies 16, 22 are shown as being monolithic, but may be of multipart construction and/or of a coated material.

Tube side fluid (not illustrated) is introduced into the heat transfer tubes 14 via the inlet tube sheet 20. The tube side fluid flows through the tubes 14 and is discharged via the discharge tube sheet 26. The tube sheets 20, 26 and the tubes 14 separate the tube side fluid from shell side fluid (not shown). The tubes 14 allow for heat exchange between the fluids. The shell side fluid is introduced into the shell assembly 12 via a shell side fluid inlet 28 and is discharged from the shell assembly 12 via a shell side fluid outlet 30.

The tube sheets 20, 26 have openings 32 (FIGS. 2-4) that each receive a corresponding end of one of the tubes 14. Each end of each tube 14 may be secured to the respective tube sheet 20, 26 with a tube nut 34 that, in one embodiment, is threadably mated with the respective opening 32. One or more additional elements, such as seals, rings and other fittings, may be present at the junction of the tubes 14 and tube sheets 20, 26.

Figure 2:
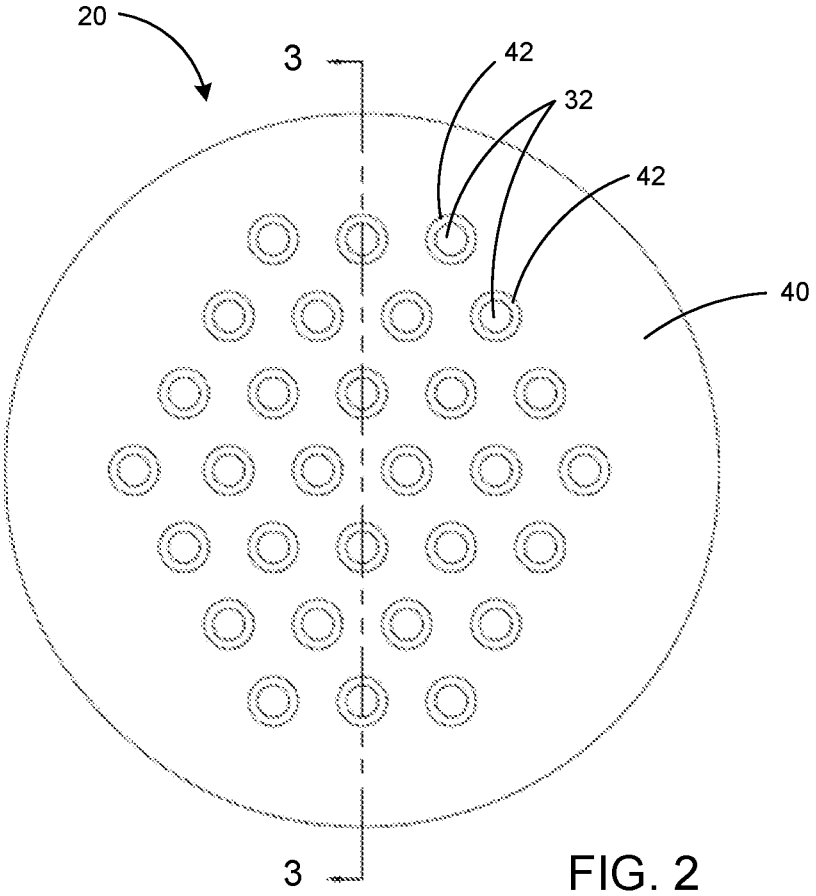
FIG. 2 is a front view of a tube sheet according to aspects of the disclosure.
Figure 3:
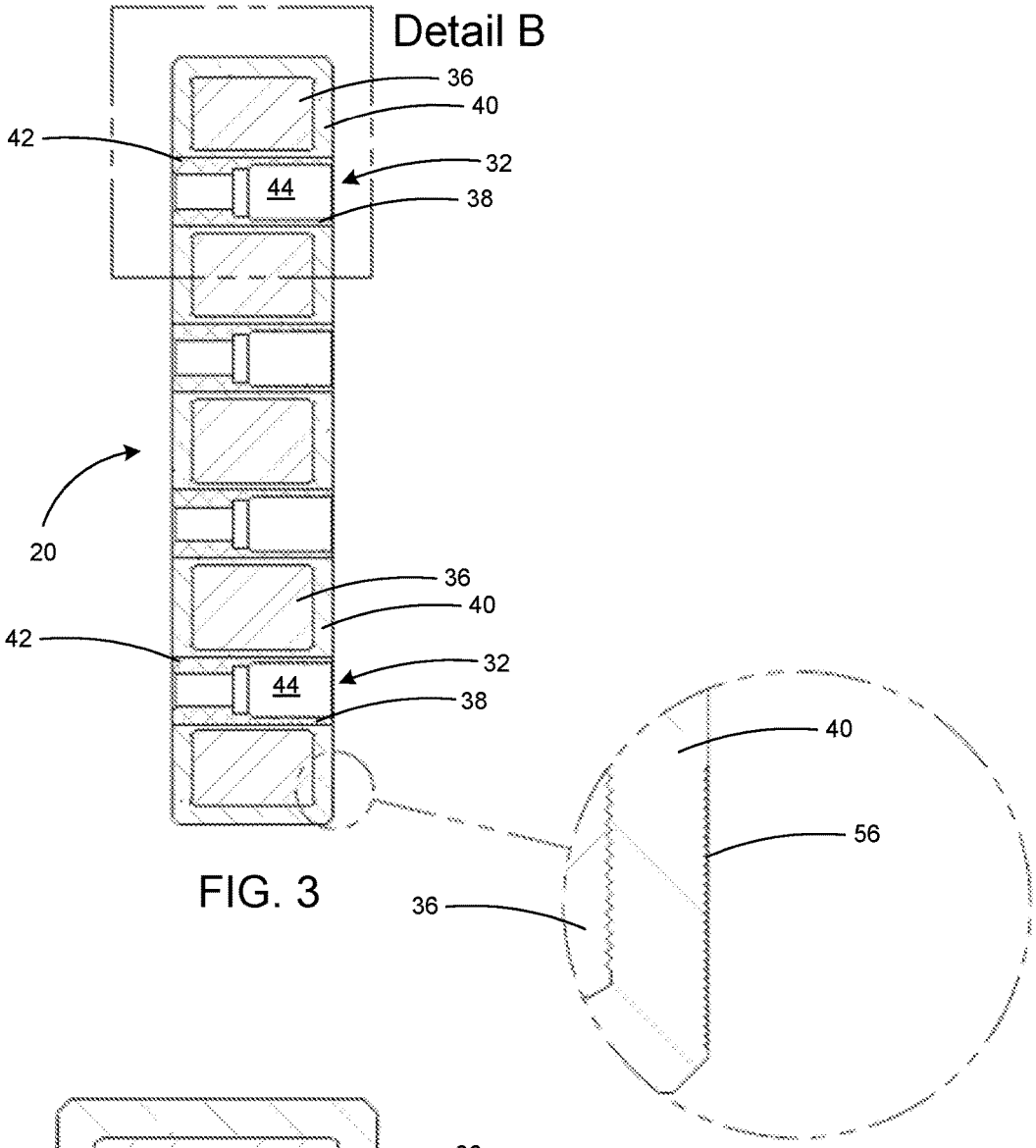
FIG. 3, inclusive of Detail A, is a cross-section of the tube sheet taken along the line 3-3 in FIG. 2.
Figure 4:
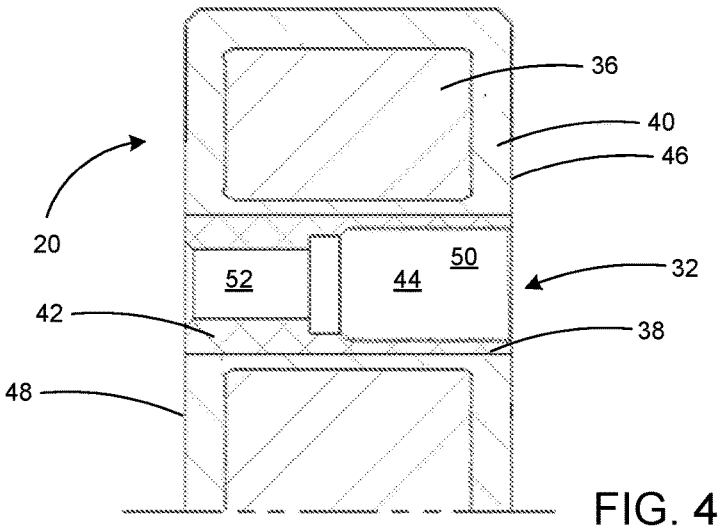
FIG. 4 is an enlargement of Detail B from FIG. 3.

With additional reference to FIGS. 2-4, the tube sheets 20, 26 will be described in detail. FIG. 2 is a front view of tube sheet 20. As indicated, the description of tube sheet 20 applies equally to tube sheet 26.

The tube sheet 20 has a substrate 36 made from strong and typically rigid material. In one embodiment, the substrate 36 is made from steel. In one embodiment, the steel of the substrate 36 is carbon steel, such as SA-516 GR 70.

The substrate 36 of the illustrated embodiment is a circular disk (although other shapes are possible) and has a plurality of through holes 38 that correspond to the locations of the tube openings 32. The substrate 36 is encapsulated by a lining 40. In one embodiment, the lining 40 is made from a first material. The first material is preferably melt-processable so that, during manufacture of the tube sheet 20, the first material is able to flow around the substrate 36. The first material may be a polymer, such as a fluoropolymer. An exemplary material for the first material is perfluoroalkoxy (PFA). In one embodiment, the lining 40 contiguously covers all surfaces of the substrate 36, including a front side (e.g., a side facing the tube side fluid), a rear side (e.g., a side facing the shell side fluid), a perimeter edge, and side walls of the holes 38. As best shown in Detail A, at least some of the surfaces of the substrate 36 may be textured (e.g., serrated, grooved, knurled, etc.) to provide additional surface area and surface variations to which the lining 40 may interface to improve adhesion of the lining 40 to the substrate 36. In the illustrated embodiment, the front and rear sides of the substrate 36 are serrated. In other embodiments, the perimeter edges and/or side walls of the holes 38 may be textured in addition to or instead of the front and rear sides of the substrate 36.

A plug 42 is located in each hole 38 of the substrate 36. The lining 40 separates the plug 42 from the substrate 36. In one embodiment, the plugs 42 are made from a second material, different than the first material, and need not be melt-processable. The plugs 42 may be made from a polymer, such as a fluoropolymer. For instance, the plugs 42 may be made from polytetrafluoroethylene (PTFE). In one embodiment, the plugs 42 are made from 15% glass filled PTFE.

Each plug 42 has a through passage 44 extending from a front surface 46 of the tube sheet 20 and a rear surface 48 of the tube sheet 26. The passage 44 forms the opening 32 for a respective end of one of the tubes 14. In one embodiment, a front portion 50 of the passage 44 at the front surface 46 has a larger diameter than a rear portion 52 of the passage 44 at the rear surface 48. In this embodiment, the end of the tube 14 may terminate in the front portion 50 of the passage 44. The front portion 50 of the passage 44 may be threaded to mate with the tube nut 34.

In one embodiment, the exterior surface of the plug 42 is smooth. In another embodiment, at least a portion of the exterior surface of the plug 42 is textured (e.g., serrated, grooved, knurled, etc.) to provide additional surface area and surface variations to which the lining 40 may interface to improve adhesion of the lining 40 to the plug 42.

As best shown in Detail A, a portion of the lining 40 that contacts the shell assembly 12 and/or a portion of the lining 40 that contacts a respective one of the clamp plate assemblies 16, 22 may have concentric grooves 56 or other surface features. The grooves or surface features may facilitate sealing of the tube sheet 20 with the shell assembly 12 and the appropriate one of the clamp plate assemblies 16, 22.

The tube sheet 20 may be manufactured in any appropriate manner. For instance, solid cylindrical blanks of the material of the plugs 42 (plug blanks) may be positioned in each hole 38 of the substrate 36 while leaving a radial gap between each cylinder and the corresponding sidewalls of the hole 38. Then, the material of the lining 40 may be melted (or otherwise made flowable) and flowed around the substrate 36 to cover the surfaces of the substrate 36 to a desired thickness, including filling the radial gap between each plug blank and the corresponding sidewalls of the holes 38. The lining 40 may be cured or allowed to harden as is appropriate. Next, the plug blanks are secured (e.g., bonded) to the lining 40, such as by welding, curing or drying adhesive, etc. Then, the plug blanks are machined to form the passages 44 and threads may be introduced into the front portion 50, resulting in the plugs 42. In another embodiment, the plugs 42 are formed from the plug blanks before covering the substrate 36 with the material of the lining 40. Other modifications to the manufacturing process may be made as is appropriate for the specific characteristics of the tube sheet 20.

As indicated, the tube sheets 20, 26 may be used in a corrosion-resistant heat exchanger 10, such as a heat exchanger 10 having glass or ceramic tubing. The tube sheets 20, 26 may be installed in a new heat exchanger or used to retrofit an existing heat exchanger. Similarly, the tube sheets 20, 26 may be used in a new or existing graphite heat exchanger, where the tube sheets are conventionally made from graphite. Therefore, the tube sheets 20, 26 may be used in situations where the tubes are made from graphite. Such a substitution is possible since the sealing methodology for non-graphite tubes (e.g., glass and ceramic) may be applied to other materials, including graphite. The use of tube sheets 20, 26 in place of graphite tube sheets may be desirable since the tube sheets 20, 26 allow for relatively large diameter heat exchangers that are otherwise difficult to achieve with graphite tube sheets. For instance, monolithic graphite tube sheets are size-limited. Fabricated graphite tube sheets, which can be larger than monolithic graphite tube sheets, are difficult to manufacture and are prone to failure. The tube sheets 20, 26 may be thinner (and cheaper) than comparably sized graphite tube sheets, which are made to be very thick for strength reasons. Regardless of the tube material, the tube sheets 20, 26 and/or the tubes are easily removed from the heat exchanger to allow for maintenance and repair, or replacement of individual tubes, if needed.

Although certain embodiments have been shown and described, it is understood that equivalents and modifications falling within the scope of the appended claims will occur to others who are skilled in the art upon the reading and understanding of this specification.

What is claimed is:

1. A shell and tube heat exchanger, comprising:

an inlet tube sheet;

a discharge tube sheet, wherein at least one of the inlet tube sheet or the discharge tube sheet comprises:

a metal substrate having a plurality of through holes;

a plug made from a non-melt-processable polymer and located in each through hole; and a lining made from a melt-processable polymer, the lining encapsulating the substrate and fills a gap between each plug and the substrate;

a shell having a shell side fluid inlet and a shell side fluid outlet; and a plurality of tubes made from corrosion-resistant material, ceramic or graphite, each tube having a first end secured in the inlet tube sheet with a first fastener and a second end secured in the discharge tube sheet with a second fastener;

wherein each plug has a through passage shaped to receive a corresponding end of a corresponding one of the tubes and to receive a corresponding one of the fasteners between the through passage and the corresponding end of the corresponding tube to retain and/or seal the corresponding end of the corresponding tube in the plug.

2. The shell and tube heat exchanger of claim 1, further comprising an inlet clamp plate that secures to the shell and holds the inlet tube sheet to a first opening in the shell and a discharge clamp plate that secures to the shell and holds the discharge tube sheet to a second opening in shell.

3. The shell and tube heat exchanger of claim 1, wherein the tubes are made from glass or ceramic.

4. The shell and tube heat exchanger of claim 1, wherein the tubes are made from graphite.

5. The shell and tube heat exchanger of claim 1, wherein the tubes comprise graphite.

6. The tube sheet of claim 1, wherein the substrate is made from steel.

7. The tube sheet of claim 1, wherein the lining is made from perfluoroalkoxy (PFA) and the plug is made from polytetrafluoroethylene (PTFE) or glass filled polytetrafluoroethylene (PTFE).

8. The shell and tube heat exchanger of claim 1, wherein each plug is chemically bonded or heat bonded to the lining.

9. The shell and tube heat exchanger of claim 1, wherein the first and second fasteners are tube nuts that threadably engage with the through passage of the corresponding plug.

* * * * *